US005584342A

United States Patent [19]

Swinford

[11] Patent Number: 5,584,342

[45] Date of Patent: Dec. 17, 1996

[54] SUBTERRANEAN ROTATION-INDUCING DEVICE AND METHOD

[75] Inventor: Jerry L. Swinford, Pearland, Tex.

[73] Assignee: Ponder Industries, Inc., Alice, Tex.

[21] Appl. No.: 471,774

[22] Filed: Jun. 6, 1995

[51] Int. Cl.[6] ..... E21B 23/00

[52] U.S. Cl. ..... 166/301; 166/237

[58] Field of Search ..... 74/127; 166/301, 166/381, 237, 242.7

[56] References Cited

U.S. PATENT DOCUMENTS

| | | | |
|---|---|---|---|
| 1,964,913 | 7/1934 | Haliburton . | |
| 2,709,104 | 5/1955 | Gibbs . | |
| 2,960,132 | 11/1960 | Finkeldei | 74/127 |
| 3,171,501 | 3/1965 | Lear | 74/127 X |
| 3,227,214 | 1/1966 | Whann . | |
| 3,916,998 | 11/1975 | Bass, Jr. et al. . | |
| 5,133,404 | 7/1992 | Dollison | 166/72 |
| 5,244,547 | 7/1993 | Burns, Sr. et al. . | |
| 5,310,001 | 5/1994 | Burns, Sr. et al. . | |
| 5,454,420 | 10/1995 | Snider et al. . | |

*Primary Examiner*—William P. Neuder
*Attorney, Agent, or Firm*—Fulbright & Jaworski L.L.P.

[57] ABSTRACT

A subterranean rotation-inducing device and method for translating axial motion into rotational motion at a remote location. A barrel slidably and rotatably maintains a sleeve within its axial bore. The sleeve's axial range of motion is limited by a shoulder within the barrel bore and a retainer ring removably attached to the lower end of the barrel. A rotation member having threading, or worm-type gearing, thereon mates with cooperative threading in the sleeve bore. A lower seal connected to the upper end of the rotation member and above the sleeve maintains the rotation member at least partially within the barrel at all times. Detents on the outer surface of the sleeve selectively interact with a clutch plate that extends partially through a receiving slot and into the barrel bore. When the barrel moves downward relative to the rotation member, the sleeve is forced upward causing engagement of the detents and the clutch plate. In this position, the sleeve cannot rotate. When the barrel moves upward relative to the rotation member, the sleeve is forced downward and the detents do not engage the clutch plate. In this position, the sleeve does rotate. In this way, the rotation member rotates in response to downward relative motion of the barrel but does not rotate in response to upward relative motion of the barrel. A housing protects the device's components and facilitates creation of an inner seal. The method includes functionally applying the above-described device.

16 Claims, 4 Drawing Sheets

SUBTERRANEAN ROTATION-INDUCING DEVICE AND METHOD

BACKGROUND OF THE INVENTION

1. Field of Invention

This invention relates to a rotation-inducing device. More specifically, it is directed to a device that provides rotation of a lower portion relative to a nonrotating upper portion and that provides subterranean operation or operation in another similar remote location. An example of an operation in a similar remote location includes removing blockage in a pipe having discrete access sites.

Many subterranean applications utilize a surface communication apparatus that cannot rotate and, thereby, provide rotation at the remote subterranean location. Illustrative of such nonrotating surface communication apparatus is a coil tubing commonly used in the oil recovery industry.

However, a number of applications, such as coil tubing fishing operations, alignment of directional coil tubing drilling operations, down-hole impact hammer applications, and pipe line cleaning operations, either require rotation at the remote location or would be enhanced thereby. For clarity and ease of description, the remainder of this application shall use the above-mentioned example of a coil tubing fishing operation to describe the present invention.

Often during drilling, the drilling string breaks leaving the "tool string" at the bottom of the hole. This lost tool string is commonly referred to as the "fish." In a coil tubing fishing operation, a coil tubing, having a "fishing string" thereon, extends through a production tubing to connect the fish. The fishing string includes a connector, such as an overshot or a spear, to accomplish the attachment of the fishing string to the fish.

An overshot utilizes rotational cutters for creating external threads similar to a die. Likewise, a spear uses rotational cutters for creating internal threads similar to a tap. When forced against the fish and rotated, the overshot (or spear) cuts threads onto the fish and, thereby, connects to the fish.

Presently, a majority of subterranean operations employ a hydraulic motor to accomplish the rotation of the lower portion, such as an overshot. However, the motors are difficult to control often causing damage to the well; the motors require hydraulic power fluid which often impairs the operation; and the motors prohibit the use of a hydraulic disconnect downstream of the motors which often results in the loss of the motors during a failed fishing attempt.

Because of the disadvantages of hydraulic motors in rotating a lower portion, such as an overshot, a purely mechanical rotation device that does not require hydraulic power fluid, that facilitates accurate rotational control, and that allows for use of a hydraulic disconnect below the rotating device is desired for subterranean applications.

2. Related Art

U.S. Pat. Nos. 5,224,547 and 5,310,001 that issued to Burns Sr. et al. disclose a retrieving tool for downhole packers utilizing non-rotational work strings and a method for accomplishing same. The apparatus disclosed by Burns utilizes mating mandrels including J-slots to facilitate rotation of the lower portion. The J-slot design translates relative axial motion of the power mandrel and inner mandrel into relative rotational motion of same. However, because of the J-slot design, the inner mandrel rotates only a fraction of a 360 degree revolution per axial stroke of the power mandrel. Consequently, the power mandrel must complete a number of axial strokes, or cycles, to produce a single 360 degree revolution of the inner mandrel. In addition, the Burns reference does not provide for the use of a hydraulic disconnect below the apparatus. Further, the Burns reference does not provide a sealed environment that will permit the transmission of a pressurized fluid therethrough.

Though the above mentioned rotation devices may be helpful in providing down-hole or remote rotation, they can be improved to provide more efficient and accurate rotation, to allow for use of a hydraulic disconnect below the device, and to provide a sealed environment that permits transmission of a pressurized fluid therethrough.

SUMMARY OF THE INVENTION

Accordingly, the objectives of this invention are to provide, inter alia, a subterranean rotation-inducing device that:

- provides rotation in a remote location;
- affords rotation of a lower portion relative to an upper portion;
- utilizes purely mechanical means to accomplish the rotation;
- translates axial motion into rotational motion;
- enables precise control of the rotation;
- permits transmission of a hydraulic disconnect actuating ball therethrough; and
- includes a sealed environment that permits transmission of a pressurized fluid therethrough.

To achieve such improvements, my invention is a subterranean rotation-inducing device that generally includes a barrel, a rotation member, and a rotation means for rotating the rotation member relative to the barrel in response to downward axial motion of the barrel relative to the rotation member. The rotation member is rotatably and slidably joined to the barrel. A connector means provides for connection of the barrel to the drive member.

Preferably, the rotation means construction provides for a rotation of the rotation member relative to the barrel that is greater than 360 degrees for each axial motion of the barrel. In addition, the preferred device allows rotation of the rotation member in response to downward relative motion of the barrel but does not permit relative rotation in response to upward relative motion of the barrel.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
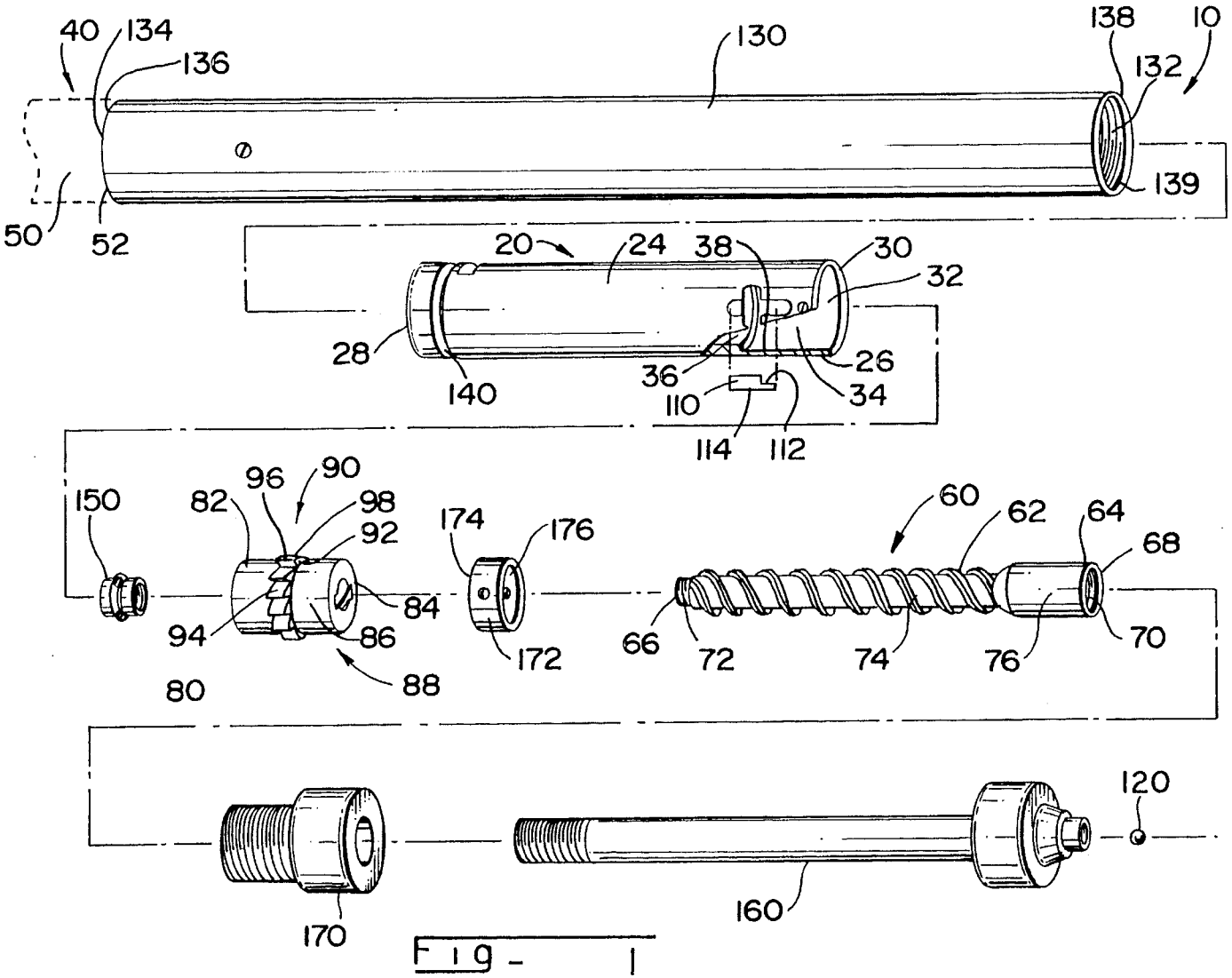
FIG. 1 is an exploded isometric view of the subterranean rotation-inducing device.
Figure 2:
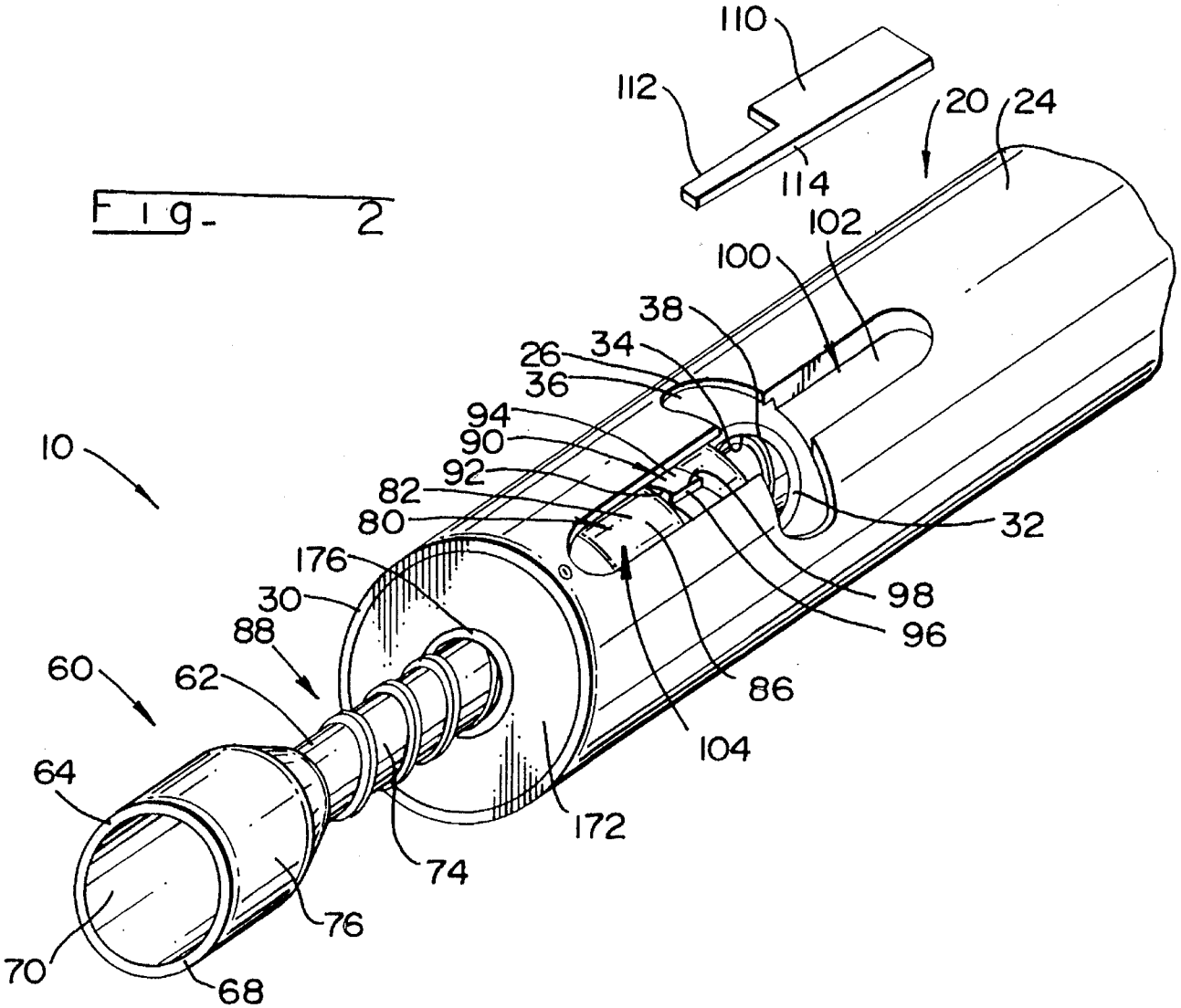
FIG. 2 is a partial isometric view of the subterranean rotation-inducing device with the clutch plate exploded from the remainder of the device.
Figure 3:
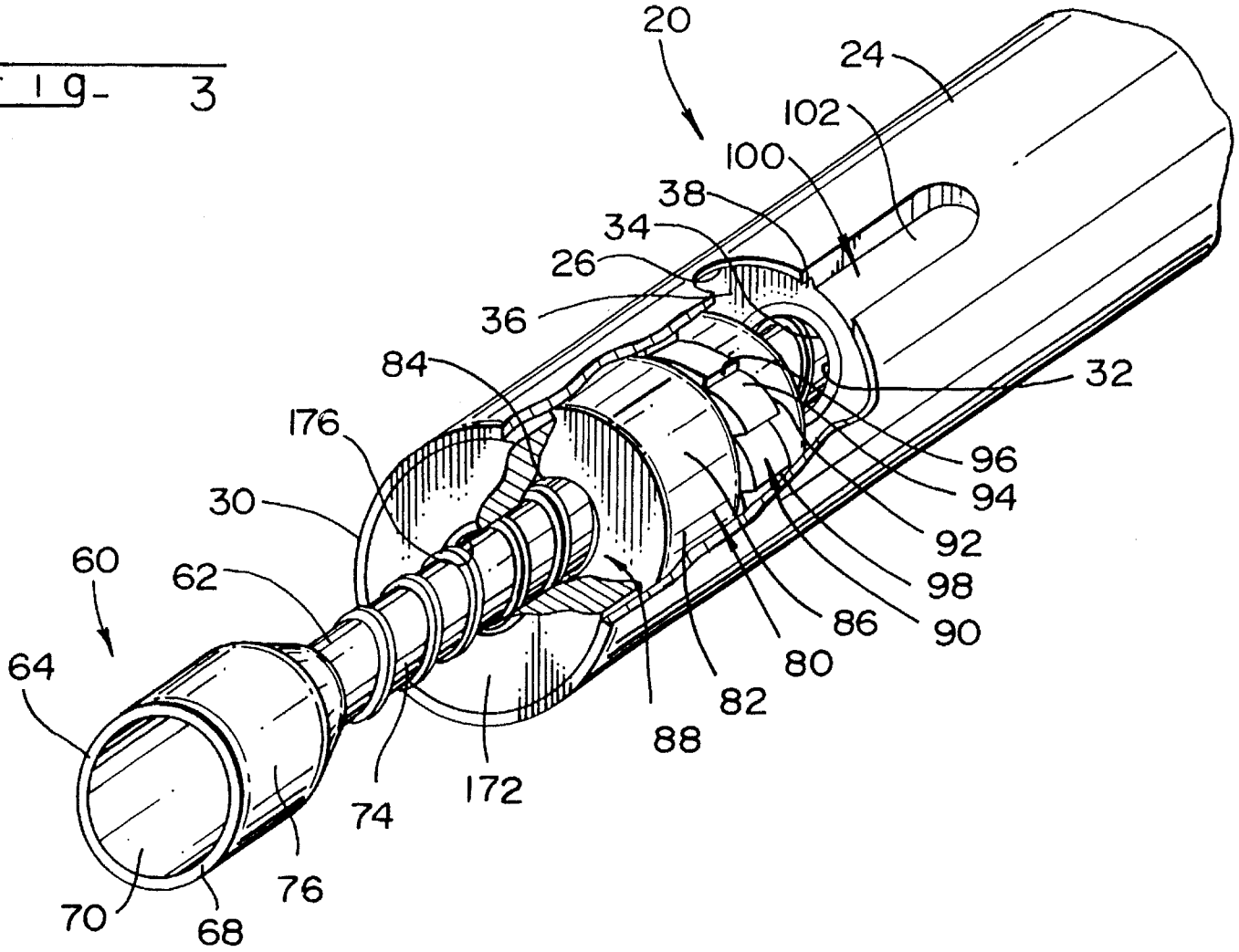
FIG. 3 is a partial isometric cross-sectional view of the subterranean rotation-inducing device showing the inner workings of the device.
Figure 4:
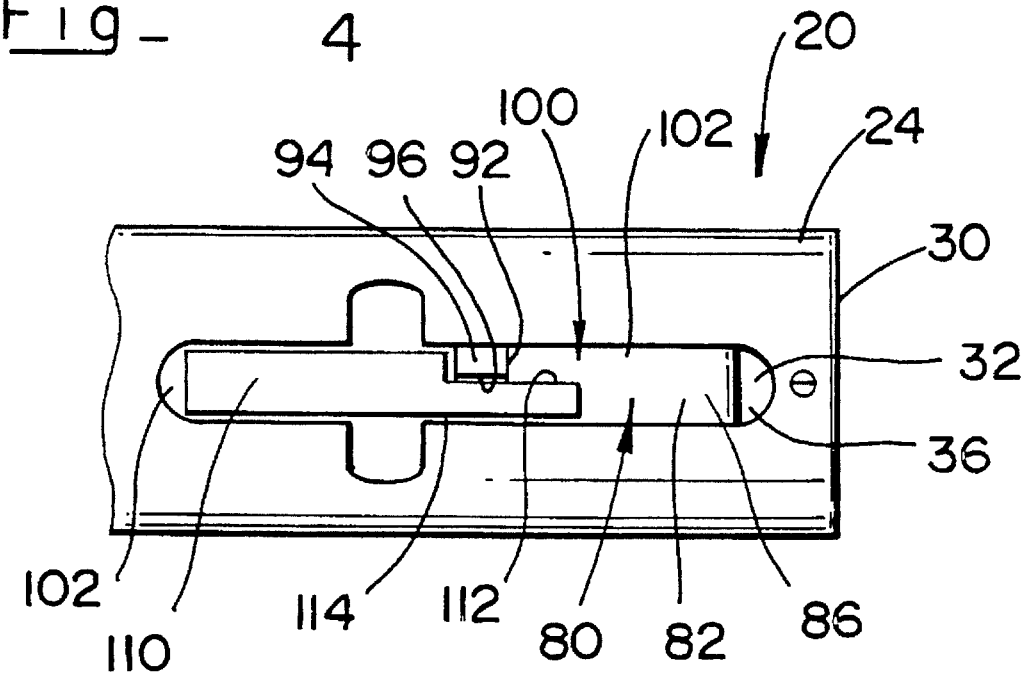
FIG. 4 is a partial top elevational view of the subterranean rotation-inducing device showing the sleeve in the first engaged position.
Figure 5:
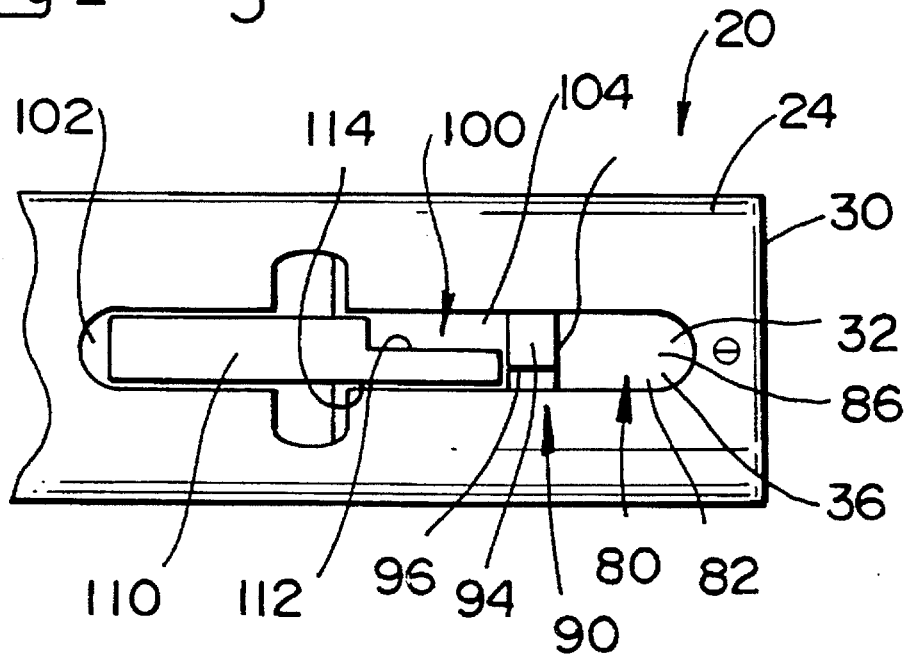
FIG. 5 is a partial top elevational view of the subterranean rotation-inducing device showing the sleeve in the second disengaged position.

The preferred embodiment of my invention is illustrated in FIGS. 1 through 5 and the subterranean rotation inducing device is depicted as 10. Basically, the subterranean rotation inducing device 10 includes a barrel 20, a connector means 40 for connecting the barrel 20 to a drive member 50, a rotation member 60 that is rotatably and slidably joined to the barrel 20, and a rotation means 80 for rotating the rotation member 60 relative to the barrel 20 in response to a downward axial motion of the barrel 20 relative to the rotation member.

Throughout this description, "upper" shall refer to the end proximal the drive member 50. Accordingly, "upward" shall mean toward the upper end, or toward the drive member 50. Likewise, "lower" shall refer to the end distal the drive member 50; and downward shall mean toward the lower end, or away from the drive member 50.

The barrel 20 has an elongated cylindrical barrel body 24. The barrel body 24 has a barrel wall 26, a barrel upper end 28, and a barrel lower end 30. A cylindrical barrel bore 32 extends through the barrel body 24 from the barrel upper end 28 to the barrel lower end 30. The barrel bore 32 is sized and constructed to permit a hydraulic disconnect actuating ball 120 to pass therethrough. The barrel bore lower portion 36 has a greater diameter than the barrel bore upper portion 34. The barrel wall 26 defines a sleeve abutment shoulder 38 at the intersection of the barrel bore lower portion 36 and the barrel bore upper portion 34.

Likewise, the rotation member 60 has an elongated, cylindrical rotation member body 62. The rotation member body 62 has an upper mating portion 74 and a lower portion 76. The lower portion 76 outer diameter is preferably greater than the upper mating portion 74 outer diameter. Additionally, the upper mating portion 74 outer diameter is preferably smaller than the inner diameter of the barrel bore 32 to facilitate sliding receipt therein. A rotation member bore 70, defined by a rotation member wall 64, extends from a rotation member upper end 66 to a rotation member lower end 68. The rotation member bore 70 is sized and constructed to permit a hydraulic disconnect actuating ball 120 to pass therethrough.

A threaded receiver 72 at the rotation member lower end 68 facilitates connection of the rotation member 60 to a connector such as an overshot or a spear. Preferably, an extension member 160 threadedly engages the threaded receiver 72 of the rotation member 60 and provides for attachment to a connector.

The subterranean rotation inducing device 10 incorporates an elongated, cylindrical housing 130 that has a housing bore 132 therethrough. The housing 130 receives and houses the barrel 20 and the rotation member 60 in the housing bore 132. Preferably, a set screw through the housing mates with a flat area on the barrel 20 to maintain the relative position of the barrel 20 to the housing 130. A threaded portion 136 of the housing 130 proximal the housing upper end 134 facilitates connection of the housing 130 to the drive member 50. The threaded portion 136 of the housing 130 is sized and constructed to mate with cooperative threading 52 of the drive member 50. Thus, the housing 130 connects to the drive member 50 and maintains the barrel 20 therein and, thereby, forms the connector means 40 for connecting the barrel 20 to the drive member 50.

The housing lower end 138 includes a lower internal threaded portion 139. A lower housing cap 170 threadedly connects to the housing lower end 138 and facilitates maintenance of the barrel 20 and the rotation member 60 in the housing bore 132. In addition, the housing cap 170 provides protection of the subterranean rotation-inducing device's 10 components from damage.

In the embodiment including a housing 130, the extension member 160 extends from the rotation member 60 and through an orifice in the lower housing cap 170. In this way, the extension member 160 facilitates connection of the rotation member 60 to the connector.

It is apparent that a number of variations for the design and construction of the above-described components, their interconnection, and the attachment to the connector. For example, the extension member 160 could be integral with the rotation member 60; or the rotation member 60 could simply extend through the lower housing cap 170 with the extension member 160 omitted.

The rotation means 80 provides for rotation of the rotation member 60 relative to the barrel 20 in response to downward axial motion of the barrel 20 relative to the rotation member 60. In addition, during upward axial motion of the barrel 20 relative to the rotation member, the rotation means 80 substantially maintains the relative rotational position of the rotation member 60 to the barrel 20. In this way, the barrel travels downward causing the rotation member 60 to rotate. When the axial motion of the barrel 20 is reversed, the rotation member 60 does not rotate. Thus, the rotation member 60 maintains its previous rotational position. The barrel 20 may then travel downward again causing further rotation of the rotation member 60. Accordingly, the resultant relative rotation of the rotation member 60 is unlimited because the barrel 20 can repeat the axial motion cycle an unlimited number of times.

However, each axial motion cycle of the barrel 20 requires both time and energy. Thus, increasing the rotation of the rotation member 60 for each axial motion cycle provides for greater efficiency. In the preferred embodiment of the present invention, the rotation means 80 allows for a plurality of 360 degree rotations for each axial motion cycle of the barrel 20. Modification of the preferred embodiment would allow for any fraction of rotations thereof.

Structurally, the preferred embodiment of the rotation means 80 includes a sleeve 82 positioned within the barrel 20, a cooperating cam means 88 between the sleeve 82 and the rotation member 60, and at least one detent 90 on the sleeve 82 that cooperates with a clutch plate 110 to permit rotation of the sleeve 82 in one direction but not the other.

The sleeve 82 is cylindrical in shape and has a sleeve bore 84 therethrough. To facilitate placement of the sleeve 822 in the barrel 20, the sleeve 82 has an outer diameter that is smaller than the inner diameter of the barrel bore lower portion 36 and allows sufficient clearance therebetween for the at least one detent 90. Because of the clearance between the sleeve 82 and the barrel 20, the sleeve 82 is free to slide and rotate within the barrel bore 32. An annular sleeve retainer ring 172 that is removably attachable to the barrel lower end 30 maintains the sleeve 82 within the barrel 90. An upwardly facing end of the sleeve retainer ring 172, the sleeve retainer ring abutment face 174, is constructed for abutment with the sleeve 82. To permit the sleeve to slide axially within the barrel bore lower portion 36, the length of the sleeve 82 is less than the axial distance from the sleeve abutment shoulder 38 to the sleeve retainer ring abutment face 174.

The rotation member 60 extends through the sleeve bore 84. Accordingly, the rotation member body upper mating portion 74 outer diameter is less than the inner diameter of the sleeve bore 84 and the sleeve retainer ring orifice 176. However, to prevent the rotation member 60 from fully retracting into the barrel 20, the rotation member body lower portion 76 outer diameter is greater than the inner diameter of the sleeve retainer ring orifice 176.

Between the sleeve 82 and the rotation member body upper mating portion 74, cooperating cam means 88 translates axial relative motion of the rotation member 60 into relative rotational motion of the rotation member 60. Preferably, the cooperating cam means 88 comprises mating threads or worm-type gears on the rotation member body upper mating portion 74 and the sleeve bore 84.

Preferably, the sleeve 82 includes a plurality of detents 90 positioned in a plane perpendicular to the axis about its circumference on the sleeve outer surface 86. The detents 90 are positioned intermediate the ends of the sleeve 82. Each detent 90 is preferably a protruding tooth 92 having a ramp surface 94 and an engagement face 96 and a length that is less than the length of the sleeve 82. The engagement face 96 extends in a substantially radial plane of the sleeve 82. The ramp surface 94 extends from the sleeve outer surface 86 at an angle and intersects the engagement face 96 at the tooth tip 98. The ramp surface 94 is either substantially planar or arcuate.

The barrel wall 26 has a receiving slot 100 therein. A portion of the receiving slot 100 extends through the barrel wall 26 creating a receiving slot open portion 104. The remainder of the receiving slot 100 extends only partially through the barrel wall 26 creating a land area 102 therein.

A clutch plate 110 positioned in the receiving slot 100 partially rests on the land area 102 and partially extends into the receiving slot open portion 104. However, the clutch plate 110 does not extend the full length of the receiving slot 100. The length of the clutch plate 110 and the sleeve 82 and detent 90 lengths are such that the sleeve 82 may slide to a position wherein the detents 90 are below the clutch plate 110 and do not contact it.

The tight clearance between the housing 130 and the barrel 20 maintains the clutch plate 110 in position. The portion of the clutch plate 110 that extends into the receiving slot open portion 104 is not as wide as the receiving slot 100. One side of the clutch plate 110, the clutch plate support surface, abuts the barrel wall 26 and provides support for the clutch plate 110. The portion of the opposing side of the clutch plate 110 that extends into the receiving slot open portion 104, the clutch plate tooth engagement surface 112, is constructed for mating abutment with the tooth engagement face 96. In this way, the receiving slot 100 and the clutch plate 110 are constructed to provide for working interaction between the detents 90 and the clutch plate 110.

For reference purposes, the remainder of the description shall use the following conventions and references. Rotation of the parts are referred to as clockwise or counterclockwise as viewed from the bottom end of the subterranean rotation-inducing device 10. Downward axial motion of the barrel 20 produces a counterclockwise rotation of the rotation member 60. Upward axial motion of the barrel 20 produces counterclockwise rotation of the sleeve 82.

The engagement of clutch plate 110 and the at least one detent 90 prevents rotation of the sleeve 82 in response to downward axial motion of the barrel 20 relative to the rotation member 60 and the disengagement of clutch plate 110 and the at least one detent 90 permits rotation of the sleeve 82 in response to upward axial motion of the barrel 20 relative to the rotation member 60. As described above, the sleeve 82 is free to slide within the barrel bore lower portion 36.

When the barrel 20 moves downwardly, the rotation member 60 forces the sleeve 82 upward into abutment with the sleeve abutment shoulder 38. In this first engagement position, wherein the sleeve 82 abuts the sleeve abutment shoulder 38, the engagement face 96 of a tooth 92 contacts the clutch plate tooth engagement surface 112 and prevents the rotation of the sleeve 82. Thus, as the barrel 20 moves axially downward, the cooperating cam means 88 causes the rotation member 60 to rotate.

When the barrel moves upwardly, the rotation member 60 forces the sleeve 82 downward into abutment with the sleeve retainer ring abutment face 174. In this second disengaged position, in which the sleeve 60 abuts the sleeve retainer ring abutment face 174, the teeth 92 are positioned below the clutch plate 110. Therefore, the teeth 92 do not contact the clutch plate 110 and the sleeve 82 is free to rotate. Because the sleeve 82 has less mass and lower friction forces acting upon it than the rotation member 60, the sleeve 82 rotates as the barrel 20 moves axially upward.

A lower seal 150 threadedly mates with and attaches to the rotation member body upper end 66 at a position above the sleeve 82. The outer diameter of the lower seal 150 prevents it from passing through the sleeve 82. Thus, the rotation member 60 is at least partially maintained in the barrel 20 at all times. In addition, the outer diameter of the lower seal 150 includes a seal, such as an o-ring, that maintains pressure within the rotation member bore 70 and the barrel bore An upper seal 140 positioned proximal the barrel upper end 28 between the barrel 20 and the housing 130 acts in combination with the lower seal 150 to maintain the pressure within the rotation member bore 70 and the barrel bore 32. In this way, the subterranean rotation-inducing device 10 provides a sealed environment that permits transmission of a pressurized fluid therethrough.

A method of inducing relative rotation at a remote location comprises functionally applying the above-described subterranean rotation-inducing device 10. Application of the subterranean rotation-inducing device 10 includes connecting it to a drive member 50, extending the subterranean rotation-inducing device 10 into a remote location, and applying axial motion cycles with the drive member 50.

I claim:

1. A subterranean rotation-inducing device, comprising:

a barrel having an axis;

a connector means for connecting said barrel to a drive member;

a rotation member rotatably and slidably joined to said barrel; and rotation means for rotating said rotation member relative to said barrel in response to upward axial motion of said barrel relative to said rotation member;

wherein said barrel comprises:

an elongated, cylindrical barrel body having a barrel wall, a barrel upper end, and a barrel lower end;

a cylindrical barrel bore defined by said barrel wall; and wherein said barrel bore extends through said barrel body from said barrel upper end to said barrel lower end.

2. A subterranean rotation-inducing device as in claim 1, wherein said rotation means substantially maintains the relative rotational position of said rotation member to said barrel during upward axial motion of said barrel relative to said rotation member.

3. A subterranean rotation-inducing device as claimed in claim 1 wherein said rotation means providing at least one 30 degree rotation of said rotation member relative to said barrel for each downward axial motion of said barrel.

4. A subterranean rotation-inducing device as claimed in claim 3 wherein said rotation means providing at least one 360 degree rotation of said rotation member relative to said barrel for each downward axial motion of said barrel.

5. A subterranean rotation-inducing device as claimed in claim 3, wherein:

said rotation means provides at least one rotation of said rotation member relative to said barrel for each downward axial motion of said barrel; and said at least one rotation being greater than 360 degrees.

6. A subterranean rotation-inducing device as claimed in claim 1, wherein said barrel bore has a diameter sufficiently large to permit a hydraulic disconnect actuating ball to pass therethrough.

7. A subterranean rotation-inducing device as claimed in claim 1 further comprising:

an elongated, cylindrical housing having a housing bore therethrough;

said barrel maintained in said housing bore; and said rotating member maintained in said housing bore.

8. A subterranean rotation-inducing device as claimed in claim 7 wherein said connector means comprises:

said housing having a housing upper end;

said housing upper end having a threaded portion;

said threaded portion sized and constructed to threadedly mate with a cooperative threading of said drive member;

and thereby said housing is threadedly connected to said drive member and, thus, said barrel is connected to said drive member.

9. A subterranean rotation-inducing device as claimed in claim 7 wherein said rotation member comprises:

an elongated, cylindrical rotation member body having a rotation member wall, a rotation member upper end and a rotation member lower end;

a cylindrical rotation member bore defined by said rotation member wall; and said rotation member bore extending through said rotation member body from said rotation member upper end to said rotation member lower end.

10. A subterranean rotation-inducing device as claimed in claim 9 wherein said cylindrical rotation member bore has a diameter sufficiently large to permit a hydraulic disconnect actuating ball to pass therethrough.

11. A subterranean rotation-inducing device as claimed in claim 10, wherein said rotation means comprises:

a sleeve having a sleeve bore therethrough and a sleeve outer surface;

said sleeve slidably and rotatably positioned in said barrel bore;

said rotation member positioned through said sleeve bore;

said sleeve having cooperating cam means for translating axial relative motion of said rotation member into relative rotational motion of said rotation member;

at least one detent on said sleeve outer surface;

a receiving slot through said barrel wall;

a clutch plate positioned in said receiving slot;

said receiving slot and said clutch plate constructed and positioned to provide working interaction between said at least one detent and said clutch plate;

said clutch plate and said at least one detent, when engaged, preventing rotation of said sleeve in response to downward axial motion of said barrel relative to said rotation member, and when disengaged permitting rotation of said sleeve in response to upward axial motion of said barrel relative to said rotation member.

12. A subterranean rotation-inducing device as claimed in claim 11 wherein each of said at least one detents comprises:

a protruding tooth having a ramp surface and an engagement face;

said engagement face extending in a substantially radial plane from said sleeve; and said ramp surface extending at an angle from said sleeve outer surface and intersecting said engagement face.

13. A subterranean rotation-inducing device as claimed in claim 11 wherein said sleeve has a plurality of detents thereon.

14. A subterranean rotation-inducing device as claimed in claim 11 further comprising:

said sleeve slidable to a first engagement position and a second disengaged position;

said at least one detent abutting said clutch plate with said sleeve in said first engaged position and said sleeve is prevented from rotating; and said at least one detent not abutting said clutch plate with said sleeve in said second disengaged position and said sleeve is permitted to rotate.

15. A subterranean rotation-inducing device as claimed in claim 9 further comprising:

an upper seal positioned between said barrel and said housing;

a lower seal positioned between said rotation member and said barrel; and thereby a pressure is maintained in said barrel bore and said rotation member bore.

16. A method of inducing relative rotation at a remote location using a subterranean rotation-inducing devices comprising the steps of:

providing a barrel having an axis;

providing a connector for connecting said barrel to a drive member;

providing a rotation member rotatably and slidably joined to said barrel;

and providing a rotation means for rotating said rotating member relative to said barrel in response to downward axial motion of said barrel relative to said rotation member;

wherein said barrel comprises:

an elongated, cylindrical barrel body having a barrel wall, a barrel upper end, and a barrel lower end;

a cylindrical barrel bore defined by said barrel wall; and wherein said barrel bore extends through said barrel body from said barrel upper end to said barrel lower end.

* * * * *

UNITED STATES PATENT AND TRADEMARK OFFICE

CERTIFICATE OF CORRECTION

PATENT NO. : 5,584,342

DATED : December 17, 1996

INVENTOR(S) : Jerry L. Swinford

It is certified that error appears in the above-identified patent and that said Letters Patent is hereby corrected as shown below:

At col. 8, line 52, delete "downward" and insert therefore --upward--.

Signed and Sealed this

Eighth Day of April, 1997

Bruce Lehman

*Attest:*

BRUCE LEHMAN

*Attesting Officer*

*Commissioner of Patents and Trademarks*